United States Patent [19]

Naruse et al.

[11] 4,309,479

[45] * Jan. 5, 1982

[54] CONDUCTIVE COMPOSITE FILAMENTS

[75] Inventors: Tsutomu Naruse, Osaka; Takao Osagawa, Settsu; Hiroshi Naito, Osaka; Masao Matsui, Takatsuki; Kazuo Okamoto, Osaka, all of Japan

[73] Assignee: Kanebo, Ltd., Tokyo, Japan

[ * ] Notice: The portion of the term of this patent subsequent to Aug. 5, 1997, has been disclaimed.

[21] Appl. No.: 138,061

[22] Filed: Apr. 7, 1980

Related U.S. Application Data

[63] Continuation of Ser. No. 931,100, Aug. 4, 1978, Pat. No. 4,216,264.

[30] Foreign Application Priority Data

Aug. 8, 1977 [JP] Japan ..... 52-95219
Aug. 8, 1977 [JP] Japan ..... 52-95220

[51] Int. Cl.[3] ..... D02G 3/00
[52] U.S. Cl. ..... 428/397; 428/367; 428/370; 428/372; 428/374
[58] Field of Search ..... 428/367, 368, 370, 372, 428/373, 374, 397; 264/171, 177 F

[56] References Cited

U.S. PATENT DOCUMENTS

| | | | |
|---|---|---|---|
| 3,803,453 | 4/1974 | Hall | 428/375 X |
| 3,853,977 | 12/1974 | Matsui et al. | 264/171 X |
| 3,966,865 | 6/1976 | Nishida et al. | 264/171 X |
| 3,969,559 | 7/1976 | Boe | 428/397 X |
| 4,045,949 | 9/1977 | Paton et al. | 428/367 X |
| 4,073,988 | 2/1978 | Nishida et al. | 428/397 X |
| 4,129,677 | 12/1978 | Boe | 428/397 X |
| 4,216,264 | 8/1980 | Naruse et al. | 428/372 X |

FOREIGN PATENT DOCUMENTS

| | | | |
|---|---|---|---|
| 2307324 | 9/1973 | Fed. Rep. of Germany | 264/171 |

*Primary Examiner*—Lorraine T. Kendell
*Attorney, Agent, or Firm*—Blanchard, Flynn, Thiel, Boutell & Tanis

[57] ABSTRACT

Conductive composite filaments in which a conductive component composed of a synthetic thermoplastic fiber-forming polymer containing conductive carbon black and a non-conductive component composed of a synthetic thermoplastic fiber-forming polymer which is same as or different from the former polymer are continuously bonded in the longitudinal direction and in the cross-section the segments of the above described conductive component are radially extended to at least two directions and the segments of the above described non-conductive component fill between the conductive segments.

15 Claims, 16 Drawing Figures

CONDUCTIVE COMPOSITE FILAMENTS

Figure 1:
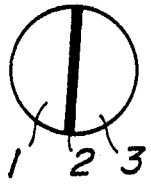

This is a continuation, of application Ser. No. 931 100, filed Aug. 4, 1978, now U.S. Pat. No. 4,216,264.

The present invention relates to conductive composite filaments, and particularly to conductive composite filaments composed of segments of a conductive component containing carbon black radially extending in at least two directions and segments of a non-conductive component which fill the spaces between said segments in the cross-section conductive of the filament.

It has been known that the static electricity is generated in usual synthetic fibers, such as polyamide fibers, polyester fibers or acrylic fibers by friction and this is a drawback of the usual synthetic fibers.

A large number of proposals concerning methods for preventing the electric charge by imparting conductivity to these usual synthetic fibers have been made.

One of the proposals is mixing of conductive carbon black in the synthetic fibers but when carbon black is mixed in the entire fibers to such a content that conductivity is provided, the properties of the fibers, for example the spinnability, strength and elongation are decreased and further the entire fibers are blackened and the appearance is deteriorated.

For obviating the defect of the conductive fibers containing carbon black, U.S. Pat. No. 3,803,453 has proposed composite filaments wherein the conductive component containing carbon black is used for the core portion and the non-conductive polymer is used for the sheath portion. In this case, the black of the core component containing carbon black, if the cross-sectional area ratio of the core component in the composite filament is less than 50%, is not relatively noticed, because the core component is covered by the sheath component containing a delustering agent, for example $TiO_2$ and the like.

However, the composite structure wherein the conductive core component is completely covered by the nonconductive sheath component, is disadvantageous for the object to provide a good antistatic property to fibrous products by blending such composite filaments in the nonconductive fibers. Finally, such composite filaments are relatively effective when the charge voltage is as high as more than 5,000 volts, but Japanese published unexamined patent application No. 143,723/76 has pointed out that when the charge voltage is as low as lower than 3,500 volts, the range of which is sensitive to the human body, the discharging speed considerably lowers.

On the other hand, said Japanese published unexamined patent application No. 143,723/76 also has proposed a composite filament having the structure that the surface of the conductive component is partially exposed to the filament surface. In this composite filament, the conductive component is present eccentrically in the cross-section of the filament and a part of the conductive component is exposed to the filament surface and when this structure is composed with the structure wherein the conductive core component is completely covered by the non-conductive sheath component, a more or less improvement concerning the speed of discharging the low voltage within the range of less than 3,500 volts which is sensitive to the human body, is recognized but such a structure is not yet satisfied. Furthermore, the control of the exposing degree of the conductive component to the fiber surface is very difficult in the production and in the case of commercial production, there are the drawbacks that the conductive component is excessively exposed and the black coloration of the filament is noticeable or reversely the conductive component is excessively covered with the non-conductive component (in some case, the conductive component is completely covered with the non-conductive component) and the conductivity of the filament lowers as in the above described U.S. patent.

The inventors have earnestly studied to improve the above described drawbacks of the conductive fibers and found that the composite filaments composed of the segments of the conductive component containing carbon black radially extending in at least two directions and the segments of the non-conductive component filling the spaces between the conductive segments in the cross-section of the filament, has excellent conductivity and discharging speed, is low in the black coloration degree and is commercially easily produced and the present invention has been accomplished.

An object of the present invention is to provide composite filaments having excellent conductivity which can produce fibrous products having a good antistatic property by blending a very small amount of the composite flaments to usual non-conductive fibers.

A further object of the present invention is to provide composite filaments having excellent conductivity and at the same time having low degree of black coloration.

Another object of the present invention is to provide composite filaments having the above described excellent properties, in which a stable cross-sectional shape can be commercially easily produced.

Other objects of the invention will become apparent from the following description.

Namely, providing present invention consists in the conductive composite filaments wherein the conductive component having an electrical resistance of less than $1\times10^{13}\ \Omega/cm$ and composed of synthetic thermoplastic fiber-forming polymer containing conductive carbon black and the non-conductive component composed of synthetic thermoplastic fiber-forming polymer which is same as or different from the above described polymer are continuously bonded in the longitudinal direction and in the cross-section the conductive component segments are radially extended in at least two directions and the non-conductive component segments fill the spaces between the former segments and the cross-sectional area of the segments of the conductive component does not exceed 50% of the cross-sectional area of the above described filament.

A more detailed explanation will be made with respect to the conductive composite filaments of the present invention.

Figure 8:
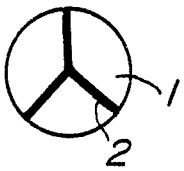
Figure 9:
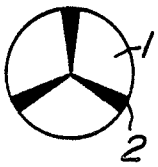
Figure 10:
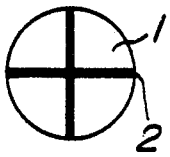
Figure 11:
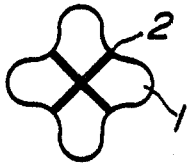
Figure 12:
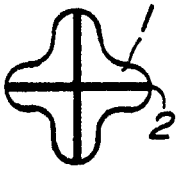
Figure 13:
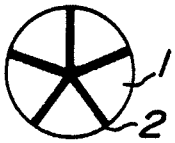
Figure 14:
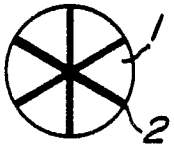
Figure 15:
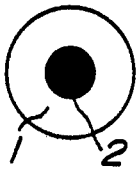
Figure 16:
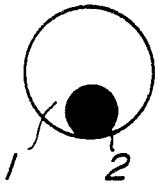

In the attached drawings,

FIGS. 1–7 show cross-sectional views of the conductive composite filaments of the present invention wherein the segments of the conductive component are radially extended into two directions, FIGS. 8 and 9 show cross-sectional views of the conductive composite filaments of the present invention wherein the segments of the conductive component are radially extended in three directions, FIGS. 10–12 show cross-sectional views of the conductive composite filaments of the present invention wherein the segments of the conductive component are radially extended in four directions, FIG. 13 shows a cross-sectional view of the conductive composite filament of the present invention wherein the segments of the conductive component are radially extended in five directions, FIG. 14 shows the cross-sectional view of the conductive composite filament of the present invention wherein the segments of the conductive component are radially extended in six directions and FIGS. 15 and 16 show the cross-sectional views of the known conductive composite filaments.

In each drawing, the numeral 2 identifies the segment of the conductive component and the numerals 1 and 3 identify the segments of the non-conductive component.

The term "composite filament composed of the segments of the conductive component radially extending in at least two directions and the segments composed of the non-conductive component filling the spaces between the conductive segments in the cross-section of the filament" means composite filaments having the cross-sections in which the segments 2 of the conductive component radially extending in to at least two directions and the segments 1 and 3 of the non-conductive component filling the spaces between the former segments are mutually bonded as shown in FIGS. 1–14. In this case, as the number of the radial segments of the conductive component becomes larger, the conductive and discharging performances are improved but at the same time the degree of black coloration increases, so that the number of the radial segments is preferred to be not more than 8, preferably 2–6, more particularly 2–4.

The characteristics of the conductive composite filaments of the present invention consist in the radial configuration of the conductive component.

Figure 2:
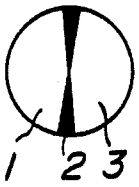
Figure 3:
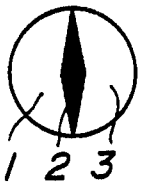
Figure 4:
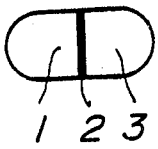
Figure 5:
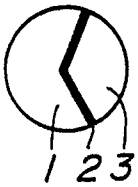

That is, in the cross-section of the filament, the segments of the conductive component are radial segments which have the radial center in the inner portion of the filament, preferably in the vicinity of the center of the filament, so that said segments are exposed at at least two portions at the surface of the filament and the exposed portions are connected with each other at the inner portion of the filament. Therefore, the charge can pass through the interior from one surface of the filament and is transferred to the other surface, so that the conductive ability and the discharging ability are noticeably superior to those of the known conductive composite filaments wherein the conductive component is surrounded by the non-conductive component as shown in FIG. 15 or the conductive component is partially surrounded by the non-conductive component and one portion is exposed to the surface as shown in FIG. 16. Of course, as the thickness of the segment of the conductive component is larger, the conductive ability of the whole composite filament is improved but it is desirable in view of the coloration degree of the whole filament that the thickness of said conductive segment is thin. Accordingly, the cross-sectional area of said segment must be less than 50% of the cross-sectional area of the composite filament, preferably less than 35%, more particularly less than 10%. When the cross-sectional area of the segment of the conductive component exceeds 50%, the black color of the composite filament is noticeable even in the product obtained by blending with other fibers and further the performance of the composite filament itself lowers. It is desirable in view of the total point of conductivity and coloration of the fibers that the thickness of the segment of the conductive component is substantially uniform. However, when a higher conductivity and discharging ability are demanded, it is preferable that the exposed area of the conductive component is larger and the object can be accomplished by adopting the cross-sectional shape as shown in FIGS. 2 and 9 wherein the thickness of the outer end portion of the segment of the conductive component is larger than the thickness of the inner portion. Conversely, when a lower degree of black coloration, that is more excellent whiteness is required, the exposed area of the conductive component is preferred to be smaller and the object can be accomplished by adopting the cross-sectional shape as shown in FIG. 3 wherein the thickness of the outer end portion of the segment of the conductive component is smaller than the thickness of the inner portion. Furthermore, it is desirable, including these cases, that the area of the conductive component exposed on the surface of the composite filament is less than 30% of the surface area of the filament, particularly less than 15%.

The term "vicinity of the center" used herein means the inner $\frac{1}{3}$ portion of the cross-section of the filament. The conductive component constituting the composite filament of the present invention is composed of the synthetic thermoplastic fiber-forming polymer containing the conductive carbon black and the non-conductive component is composed of the synthetic thermoplastic fiber-forming polymer which is same as or different from the polymer constituting the conductive component.

The synthetic thermoplastic fiber-forming polymers include polyamides, polyesters, polyvinyls, polyolefins, acrylic polymers, polyurethane and the like.

As polyamides, for example, mention may be made of polycapramide, polyhexamethyleneadipamide, nylon-4, nylon-7, nylon-11, nylon-12, nylon-610, poly-m-xylyleneadipamide, poly-p-xylyleneadipamide and the like.

As polyesters, for example, mention may be made of polyethylene terephthalate, polytetramethylene terephthalate, polyethylene oxybenzoate, 1,4-dimethylcyclohexane terephthalate, polypivalolactone and the like.

As polyvinyls, for example, mention may be made of polyvinyl chloride, polyvinylidene chloride, polyvinyl alcohol, polystyrene and the like.

As polyolefins, for example, mention may be made of polyethylene, polypropylene and the like.

As acrylic polymers, for example, mention may be made of polyacrylonitrile, polymethacrylate and the like.

Of course, copolymers consisting of monomers of the above described polymers and other known monomers also can be used.

Among the synthetic thermoplastic fiber-forming polymers, polyamides, polyesters, polyolefins and the like are preferable in view of the practicability, spinnability and the like.

Moreover, the conductive components and the non-conductive components may be constituted of the same polymers as described above or with different polymers but the segments of both the components must have full adhesion, so that it is preferable that both the components are constituted with the same kind of polymers.

The conductive components are ones wherein as mentioned above, the conductive carbon black is dispersed in the synthetic thermoplastic fiber-forming polymers but the amount of the carbon black in the polymers depends upon the kind of carbon black to be used but is 3–40% by weight based on the total amount of the conductive component, preferably 5–30% by weight, more particularly 15–30% by weight.

When the amount of carbon black is less than 3% by weight, the conductivity of the composite filament is not sufficient, while when said amount exceeds 40% by weight, it is difficult to relatively uniformly disperse said carbon black in the polymers and even if the dispersion is made by the utmost effort, the fluidity of the polymer lowers and the spinning is hindered and such an amount is not preferable.

These conductive components have the property that when a direct current of 1,000 volts is applied, the electrical resistance in the longitudinal direction is less than $1\times10^{13}$ Ω/cm, preferably less than $1\times10^{11}$ Ω/cm, more preferably less than $1\times10^{9}$ Ω/cm.

If the electrical resistance exceeds $1\times10^{-}$Ω/cm, when the usual synthetic filaments are blended, the satisfactory antistatic property can not be obtained.

The electrical resistance of the conductive component used herein means the numerical value obtained by measuring by the following process.

Namely, the conductive component and the non-conductive component are conjugate spun and drawn and the resulting composite filament is cut in a length of 10 cm and the single filament is measured with respect to the electrical resistance in the longitudinal direction under 1000 volts of direct current voltage. Furthermore, the resistance of the filament per a length of 1 cm is calculated as 1/10 of the resistance of the filament of a length of 10 cm. Moreover, the resistance value of one filament is, for example 10 times of the resistance value of 10 filaments. However, for the measurement of the electrical resistance, a high resistance meter (made by Toa Denpa Kogyo Co. Ltd.) was used.

In general, the resistance of the non-conductive component is, for example more than $1\times10^{16}$ Ω/cm and is far larger than the resistance of the conductive component. Accordingly, the resistance value measured by the above described process is substantially same as the resistance value of the conductive component.

The conductive carbon black may be dispersed in the polymer by a well known mixing process. The carbon black is thoroughly uniformly dispersed in the polymer and precaution must be paid so that the conductivity of the composite filament is not decreased owing to the non-uniformity of the dispersed state.

The conductive composite filaments of the present invention can be produced by a spinning apparatus capable of conjugate spinning of multi-component polymers while taking the properties of the polymers to be used into consideration.

As such a spinning apparatus, one concretely disclosed in U.S. Pat. No. 3,814,561 may be used.

The spun undrawn composite filaments are drawn by the conventional process at room temperature or under heating. In this case, for heating a heat roller, a heat pin and the like are used.

Figure 6:
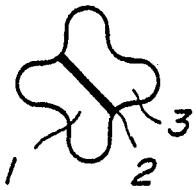
Figure 7:
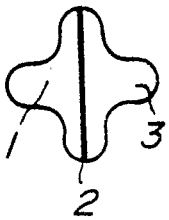

The cross-sectional shape of the composite filaments according to the present invention may be circular or non-circular. When the conductive component is exposed at concave portions in the cross-section of the filament as shown in FIGS. 6 and 11, there is a merit that it is difficult to see the segment of the conductive component due to the refraction and reflection of light due to the non-circular cross-sectional structure and the coloration is little.

As one embodiment of application of the present invention, there is a conductive composite filament having self crimpability. In general, it has been well known that a composite filament wherein two components having different shrinkages are eccentrically arranged and bonded, has self crimpability but in the case of the present invention, the self crimpability can be obtained by using two components having different shrinkages for the non-conductive component of the conductive composite filament. Such conductive composite filament having self crimpability is advantageous, because the conductive composite filament can be uniformly blended with other crimped non-conductive filaments.

In the conductive composite filaments of the present invention, the conductive component is exposed at two or more portions of the surface of the filament and all the exposed points are connected at the interior of the filament, so that the conductive ability and the discharging ability are noticeably excellent and the degree of black coloration is fairly low.

The composite filaments according to the present invention can be used in the form of continuous filaments or as staple fibers and further can be formed into fibrous structures, such as, knitted fabrics, woven fabrics, non-woven fabrics, carpets and the like by blending other fibers. When the composite filaments according to the present invention are used by blending with other fibers, the blend ratio may be optionally selected depending upon the object but in order to obtain the antistatic fibrous structures, it is merely necessary that the composite filaments according to the present invention are blended in the ratio of more than 0.1%, preferably more than 0.5%. In general, the larger the blend ratio, the stronger the antistatic property is. As the blending processes, all well known processes, for example, fiber mixing, mix spinning, doubling, doubling and twisting and unioning may be used.

Thus, by blending a very small amount of the composite filaments according to the present invention to the other fibers, for example usual synthetic filaments, the fibrous products may be made to be antistatic without substantially noticeable black coloration.

Furthermore, the composite filaments according to the present invention is characterized in that the filaments having a constant cross-sectional shape can be commercially easily produced.

The following examples are given for the purpose of illustration of this invention and are not intended as limitations thereof. In the examples, "%" means % by weight unless otherwise indicated.

The properties of fabrics in the following examples were measured in the following manner.

1. Electrical resistance of wad formed of filaments:

5 g of drawn filaments was cut and formed into a wad, the wad was interposed between two metal electrodes each having a diameter of 50 mm, and spaced apart from each other by 20 mm, and a voltage of 1,000 v was applied to the electrodes under an atmosphere kept at 20° C. and 40% RH, and the electrical resistance of the wad was measured by means of a high resistance meter (made by Toa Denpa Kogyo Co. Ltd.).

2. Charged voltage of knitted fabric due to friction:

A sample knitted fabric was conditioned for 12 hours under an atmosphere kept at 20° C. and 30% RH, and then rubbed softly with a cotton cloth by 12 times under the same atmosphere. After lapse of a given time, the charged voltage of the rubbed knitted fabric was measured by means of an electrostatic induction type detector (made by Shishido Co. Ltd.).

3. Charged voltage of carpet due to friction:

A sample carpet was conditioned for 24 hours under an atmosphere kept at 25° C. and 30% RH, and then the charged voltage of the carpet due to friction was measured in the same manner as described in the measurement of the charged voltage of the knitted fabric due to friction in the above item 2.

4. Charged voltage of human body:

Charge voltage of human body was measured by the "shuffling method" and "walking method" by means of a voltage tester according to JIS L-1021-1974.

EXAMPLE 1

Nylon-6 having a $TiO_2$ content of 2.0% and having a relative viscosity of 2.70 when measured in 1% solution of the nylon in sulfuric acid was used as a non-conductive component. Carbon black-containing nylon-6 produced by dispersing 25% of conductive carbon black in the same nylon-6 was used as a conductive component. The two components were conjugate spun at a spinning temperature of 285° C. through a spinneret disclosed in U.S. Pat. No. 3,814,561 and having 24 circular holes by melt spinning. The spun filaments were taken up on a bobbin at a take-up rate of 800 m/min, while forming into 8 multifilaments, each consisting of 3 filaments. Then, the taken-up filaments were drawn at a draw ratio of 3.1 on a hot pin having a diameter of 60 mm and kept at 110° C. to obtain drawn filaments of 20 deniers/3 filaments, which had an elongation of 40%. The resulting drawn filament had a cross-sectional shape as shown in FIG. 1, wherein segments formed of the conductive component extended radially from the center of the filament in two directions making an angle of 180°. In the filament, the conjugate ratio of the conductive component to the nonconductive component was 1:9 (the conjugate ratio is expressed by the ratio of the cross-sectional area of the conductive component to that of the non-conductive component).

The resulting composite filaments were scoured in an aqueous solution containing 4% of $Na_2CO_3$ and 1% of a surfactant (trademark: Scourol #900, made by Kao Atlas Co.) at 80° C. for 30 minutes, washed thoroughly with water and dried in air. The electrical resistance of the above treated composite filaments, and the electrical resistance of the wad formed of the above treated composite filaments were measured. The obtained results are as follows.

| | |
|---|---|
| Electrical resistance of the composite filaments | $9.1 \times 10^8$ Ω/cm |
| Electrical resistance of the wad | $8.9 \times 1.0^7$ Ω |

Then, a tubular knitted fabric consisting mainly of ordinary non-conductive nylon-6 drawn filaments of 210 deniers/54 filaments and containing about 1% of the above obtained composite filaments, which were arranged in the fabric and spaced apart from each other at intervals of 6 mm, was produced. The resulting tubular knitted fabric was scoured, washed with water and dried in air in the same manner as described above, and then the charged voltage (after 1 second and after 60 seconds) of the tubular knitted fabric due to friction was measured. The obtained results are as follows:

| | After 1 second | After 60 seconds |
|---|---|---|
| Charged voltage | 1.6 kv | 1.0 kv |

As described above, in the composite filament having the cross-sectional shape as shown in FIG. 1, segments of the conductive component are exposed at the filament surface at two portions in the cross-section of the filament, and the exposed segments are interconnected with each other in the interior of the filament. Therefore, the wad formed of the filament, which resembles a shape used in practice, has a very excellent conductive property and further is excellent in the antistatic property shown by the charged voltage due to friction.

The excellent conductive property and antistatic property of the composite filament of the present invention will be clearly understood from the comparison of the properties with those of the filament obtained in the following Comparative Examples.

COMPARATIVE EXAMPLE 1

Sheath-core conductive composite filaments having a cross-sectional shape as shown in FIG. 15 were conjugate spun and drawn according to the method disclosed in U.S. Pat. No. 3,803,453. The core component was the same 25% carbon black-containing nylon-6 as used in Example 1, and the sheath component was the same nylon-6 as used in Example 1. The conjugate ratio of the core component (conductive component) to the sheath component (non-conductive component) was 1:9. The resulting drawn composite filaments (20 deniers/3 filaments) had an elongation of 40%.

The drawn composite filaments were scoured, washed with water and dried in air in the same manner as described in Example 1, and then the electrical resistance of the composite filaments in the longitudinal axis direction was measured in the same manner as described in Example 1. Further, the electrical resistance of a wad formed of the composite filaments was measured. The obtained results are as follows.

| | |
|---|---|
| Electrical resistance of the composite filaments | $9.5 \times 10^8$ Ω/cm |
| Electrical resistance of the wad | $1.1 \times 10^9$ Ω |

A tubular knitted fabric containing the sheath-core composite filaments was produced in the same manner as described in Example 1, and the fabric was scoured, washed with water and dried in air in the same manner as described in Example 1. Then, the charged voltage (after 1 second and after 60 seconds) of the fabric due to friction was measured. The obtained results are as follows.

| | After 1 second | After 60 seconds |
|---|---|---|
| Charged voltage | 1.6 kv | 1.0 kv |

COMPARATIVE EXAMPLE 2

Conductive composite filaments having a cross-sectional shape as shown in FIG. 16, wherein a conductive component was partially surrounded with a non-conductive component, and 25% of the surface area of the conductive component was exposed to the filament surface, was conjugate spun and the extruded filaments were drawn according to the method disclosed in Japanese patent published unexamined application No. 143,723/76. The conjugate ratio of the conductive component to the non-conductive component was 1:9, and the resulting drawn composite filaments (20 deniers/3 filaments) had an elongation of 40%.

The drawn composite filament was scoured, washed with water and dried in air in the same manner as described in Example 1, and then the electrical resistance of the composite filaments in the longitudinal axis direction was measured in the same manner as described in Example 1. Further, the electrical resistance of a wad formed of the composite filaments was measured. The obtained results are as follows.

| | |
|---|---|
| Electrical resistance of the composite filament | $9.2 \times 10^8$ Ω/cm |
| Electrical resistance of the wad | $6.0 \times 10^8$ Ω |

Further, a tubular knitted fabric containing the composite filaments was produced in the same manner as described in Example 1, and the fabric was scoured, washed with water and dried in air in the same manner as described in Example 1. Then, the charged voltage (after 1 second and after 60 seconds) of the fabric due to friction was measured. The obtained results are as follows.

| | After 1 second | After 60 seconds |
|---|---|---|
| Charged voltage | 2.4 kv | 1.9 kv |

Moreover, it was required a greatest care to a produce continuously and stably the composite filament having a cross-sectional shape as shown in FIG. 16 of this Comparative Example 2.

EXAMPLE 2

Three kinds of composite filaments having a cross-sectional shape as shown in FIG. 1 were produced in the same manner as described in Example 1, except using carbon black-containing nylon-6 produced by dispersing 15%, 20% or 30% of conductive carbon black in nylon-6. The electrical properties of the resulting three kinds of composite filaments were examined, and the obtained results are shown in the following Table 1. The drawing was carried out according to the manner described in Example 1 so that the resulting three kinds of drawn filaments had an elongation of 40%. Further, scouring and other treatments were carried out in the same manner as described in Example 1.

TABLE 1

| Experiment No. | Content of carbon black of conductive component (%) | Electrical resistance: Composite filament (Ω/cm) | Electrical resistance: Wad formed of composite filament (Ω) |
|---|---|---|---|
| 2-1 | 15 | $1.1 \times 10^{11}$ | $6.1 \times 10^{10}$ |
| 2-2 | 20 | $7.1 \times 10^9$ | $9.2 \times 10^8$ |
| 2-3 | 30 | $1.4 \times 10^8$ | $1.5 \times 10^7$ |

EXAMPLE 3

Three kinds of composite filaments having a cross-sectional shape as shown in FIG. 1, wherein segments consisting of 25% carbon black-containing nylon-6 conductive component were extended radially from the center of the filament in two directions making an angle of 180°, and having a conjugate ratio of conductive component to non-conductive component of 2:8, 3:7 or 4:6, were produced, and the electrical properties of the composite filaments were examined. The materials used in the production of the composite filaments, the production method thereof and the scouring and other treatments are exactly same as those used in Example 1. The obtained results are shown in the following Table 2. The resulting three kinds of composite filaments had an elongation of 40%.

TABLE 2

| Experiment No. | Conjugate ratio (conductive component:non-conductive component) | Strength of filament (g/d) | Electrical resistance: Composite filament (Ω/cm) | Electrical resistance: Wad formed of filament (Ω) |
|---|---|---|---|---|
| 3-1 | 2:8 | 3.3 | $4.5 \times 10^8$ | $6.0 \times 10^7$ |
| 3-2 | 3:7 | 2.7 | $3.0 \times 10^8$ | $3.8 \times 10^7$ |
| 3-3 | 4:6 | 2.1 | $2.2 \times 10^8$ | $2.9 \times 10^7$ |

It can be seen from Table 2 that when the conjugate ratio of the conductive component is higher, the resulting composite filament is more excellent in the electrical resistance, but the strength of the filament lowers. Further, the degree of black coloration is higher, as the conjugate ratio of conductive component is higher.

EXAMPLE 4

Composite filaments having segments of a conductive component, which were extended radially in 3 to 6 directions in the cross-section of the filament as shown in FIGS. 8, 10, 13 or 14, were produced (conjugate ratio of conductive component to non-conductive component is 1:9), and the electrical resistance and antistatic property of the resulting filaments were examined. The used material, the production method of the composite filaments, the scouring treatment, and the production method of tubular knitted fabric are same with those of Example 1. The obtained results are shown in the following Table 3. For reference purposes, the electric resistance of the composite filament obtained in Example 1 and the charged voltage of the tubular knitted fabric containing the composite filaments due to friction are also shown in Table 3.

TABLE 3

| Experiment No. | Conjugate type: FIG. | Conjugate type: Number of radially extending segments of conductive component | Electrical resistance: Composite filament (Ω/cm) | Electrical resistance: Wad formed of filament (Ω) | Charged voltage (kv): after 1 second | Charged voltage (kv): after 60 seconds |
|---|---|---|---|---|---|---|
| 1-1 | 1 | 2 | $9.1 \times 10^8$ | $8.9 \times 10^7$ | 1.6 | 1.0 |
| 4-1 | 8 | 3 | $9.4 \times 10^8$ | $7.5 \times 10^7$ | 1.5 | 1.0 |
| 4-2 | 10 | 4 | $9.5 \times 10^8$ | $6.6 \times 10^7$ | 1.3 | 0.9 |
| 4-3 | 13 | 5 | $9.4 \times 10^8$ | $6.1 \times 10^7$ | 1.2 | 0.9 |
| 4-4 | 14 | 6 | $9.6 \times 10^8$ | $6.0 \times 10^7$ | 1.2 | 0.9 |

Further, the composite filaments having 5 and 6 radially extending conductive component segments are somewhat higher in the degree of black coloration than the composite filaments having 2 to 4 radially extending conductive component segments.

EXAMPLE 5

Polyethylene tetraphthalate having an intrinsic viscosity of 0.645 and a $TiO_2$ content of 2.0% was used as a non-conductive component, and carbon black-containing polyethylene terephthalate, which was obtained by dispersing 25% of conductive carbon black particles in the same polyethylene terephthalate, was used as a conductive component. The two components were conjugate spun at a spinning temperature of 290° C. by means of an extruder type melt spinning apparatus. A spinneret disclosed in U.S. Pat. No. 3,814,561 but having 8 circular holes was used, and the extruded filaments were taken up on a bobbin at a take-up rate of 700 m/min through an oiling roller, while forming into 8 monofilaments. The taken-up filaments were drawn at a draw-ratio of 3.5 on a roller heated at 80° C. to obtain drawn filaments (I) of 20 deniers/4 filament having an elongation of 43%. The cross-section of the resulting drawn filament had conductive component segments radially extending from the center of the filament in two directions making an angle of 180° as shown in FIG. 1. In the filaments, the conjugate ratio of the conductive component to the non-conductive component was 1:9.

Then, the same conductive component and non-conductive component as used in Example 1 were conjugate spun by means of the same spinning apparatus as described above. The same spinneret as described above was used, and the extruded filaments were taken up on a bobbin at a take-up rate of 650 m/min through an oiling roller, while forming into eight monofilaments. The taken-up filaments were drawn under the same condition as described above to obtain drawn filaments (II) of 20 deniers/1 filament having an elongation of 40%. The resulting drawn filament had the same cross-sectional shape and conjugate ratio as described above.

The resulting two kinds of composite filaments were scoured, washed with water and dried in the same manner as described in Example 1, and the electrical resistance of the conductive components of the filaments was measured.

Then, tubular knitted fabrics containing these conductive composite filaments were produced in the same manner as described in Example 1 , and scoured, washed with water and dried in the same manner as described in Example 1, and then the charged voltage (after 1 second and after 60 seconds) of the fabrics due to friction were measured.

The obtained results are shown in the following Table 4.

TABLE 4

| Experiment No. | Composite filament | Electrical resistance of composite filament (Ω/cm) | Charged voltage (kv) after 1 second | Charged voltage (kv) after 60 seconds |
|---|---|---|---|---|
| 5-1 | I | $9.8 \times 10^8$ | 1.7 | 1.2 |
| 5-2 | II | $3.2 \times 10^8$ | 1.6 | 1.1 |

It can be seen from Table 4 that, even when polyester is used as a polymer for constituting a composite filament, the resulting conductive composite filament has substantially the same excellent performance as that of a composite filament using polyamide.

EXAMPLE 6

Nylon-6 having a $TiO_2$ content of 2.0% and having a relative viscosity of 2.70 when measured in 1% solution of the nylon in sulfuric acid, and a nylon-6 copolymer having a $TiO_2$ content of 2.0% and having a relative viscosity of 2.57 when measured in 1% solution of the copolymer in sulfuric acid, which was produced by copolymerizing 10% of hexamethylenediammonium isophthalate with 90% of nylon-6, were used as non-conductive components. Carbon black-containing nylon-6 produced by dispersing 20% of conductive carbon black particles in nylon-6 having a relative viscosity of 2.70 in sulfuric acid was used as a conductive component. The three components were conjugate spun by means of an extruder type melt spinning apparatus. The spinning and drawing conditions were same as those in Example 1.

The resulting drawn filament (20 deniers/3 filaments) has a cross-sectional shape as shown in FIG. 1, wherein a segment (2) of the conductive component was interposed between a segment (1) of the non-conductive component of the nylon-6 and a segment (3) of the non-conductive component of the nylon-6 copolymer, and had a conjugate ratio of the non-conductive component to the conductive component of 9(4.5×2):1.

The composite filaments were scoured, washed with water and dried in the same manner as described in Example 1, and the electrical resistance of the conductive component and that of a wad formed of the composite filaments were measured. The obtained results are as follows.

| | |
|---|---|
| Electrical resistance of composite filament | $7.2 \times 10^9$ Ω/cm |
| Electrical resistance of the wad | $7.7 \times 10^8$ Ω |

The composite filaments were further treated with boiling water to develop fine three-dimensional crimps, and a tubular knitted fabric containing the crimped composite filaments was produced in the same manner as described in Example 1. The tubular knitted fabric was scoured, washed with water and dried, and then the charged voltage (after 1 second and after 60 seconds) of the fabric due to friction was measured. The obtained results are as follows.

| | After 1 second | After 60 seconds |
|---|---|---|
| Charged voltage | 1.8 kv | 1.1 kv |

EXAMPLE 7

Each of the conductive composite filaments (20 deniers/3 filaments) obtained in Example 1 and Comparative Examples 1 and 2 and the conductive composite filaments (20 deniers/3 filaments) obtained in Example 4, which had such a cross-section that the segments of the conductive component extended radially in four directions crossed at an angle of 90°, was doubled with a crimped non-conductive nylon-6 filament (2,600 deniers/128 filaments) to produce four kinds of antistatic filaments (2,620 deniers/131 filaments) for carpet. Each of the resulting four kinds of antistatic filaments was tufted into a loop pile carpet having a gauge of ⅛, a stitch of 8 and a pile height of 6 mm. A sample carpet of 10 cm×10 cm was cut out from the resulting carpet, and scoured, washed with water and dried in the same manner as described in Example 1, and then the charged voltage (after 1 second and after 60 seconds) of the carpet due to friction was measured. Further, the charged voltage of human body strolling on the carpet was measured. In this measurement, a sample carpet of about 100 cm×50 cm was cut out from the resulting carpet, and the sample carpet was preliminarily dried at 70° C. for 1 hour, and then aged for 24 hours under an atmosphere of 25° C. and 30% RH, and the charged voltage of human body strolling on the carpet was measured under the same atmosphere.

The obtained results are shown in the following Table 5.

For comparison, a carpet consisting only of the above described nylon-6 filaments (2,600 deniers/128 filaments) was produced in the same manner as described above. After the carpet was subjected to the after-treatment, the properties of the carpet were measured. The obtained results are also shown in Table 5.

TABLE 5

| Experiment No. | Conjugate type | Charged voltage of carpet (kv) After 1 second | Charged voltage of carpet (kv) After 60 seconds | Charged voltage of human body (kv) Shuffling method | Charged voltage of human body (kv) walking method | Remarks |
|---|---|---|---|---|---|---|
| 6-1 | FIG. 10 | 2.2 | 1.4 | −1.4 | −1.0 | Carpet of the present invention |
| 6-2 | FIG. 1 | 2.6 | 1.9 | −1.7 | −1.3 | Carpet of the present invention |
| 6-3 | FIG. 15 | 3.9 | 3.3 | −2.7 | −2.4 | Comparative carpet |
| 6-4 | FIG. 16 | 3.2 | 2.7 | −2.3 | −1.9 | Comparative carpet |
| 6-5 | Non-conductive filament only | 15.0 | 15.0 | −9.1 | −8.3 | Comparative carpet |

It can be seen from Table 5 that the use of the composite filament of the present invention in the production of carpet ensures excellent electroconductive effect and discharge effect owing to the fact that a plurality of segments of the conductive component in the composite filament of the present invention are exposed to the filament surface, and the segments are interconnected with each other in the interior of the filament.

What is claimed is:

1. A unitary, elongated, electrically conductive, composite, melt-spun filament which in transverse cross section consists of from 2 to 8 electrically conductive segments whose inner ends are integral with each other at a common center located in the central interior portion of the filament and which radiate outwardly from said center and extend to the perimeter of the filament with the outer ends of said electrically conductive segements being exposed on the outer surface of said filament, the spaces between said electrically conductive segments outwardly from said center being filled with electrically non-conductive segments whereby said electrically conductive segments are isolated from each other except at said center and only the outer ends of said electrically conductive segments are exposed, said electrically conductive segments having an electrical resistance of less than $1\times10^{13}$ Ω/cm and consisting essentially of first synthetic thermoplastic fiber-forming polyamide containing uniformly dispersed therein from 3 to 40% by weight of electrically conductive carbon black, said electrically non-conductive segments consisting essentially of second synthetic thermoplastic fiber-forming polyamide which second polyamide is different from said first polyamide, said electrically non-conductive segments being continuously bonded and having full adhesion to said electrically conductive segments along the entire length of said filament, the sum of the cross-sectional areas of said electrically conductive segments being less than 50% of the total cross-sectional area of said filament and the sum of the exposed areas of said electrically conductive segments on the surface of said filament being less than 30% of the total surface area of said filament.

2. A unitary, elongated, electrically conductive, composite, melt-spun filament which in transverse cross section consists of from 2 of 8 electrically conductive segments whose inner ends are integral with each other at a common center located in the central interior portion of the filament and which radiate outwardly from said center and extend to the perimeter of the filament with the outer ends of said electrically conductive segments being exposed on the outer surface of said filament, the spaces between said electrically conductive segments outwardly from said center being filled with electrically non-conductive segments whereby said electrically conductive segments are isolated from each other except at said center and only the outer ends of said electrically conductive segments are exposed, said electrically conductive segments having an electrical resistance of less than $1\times10^{13}$ Ω/cm and consisting essentially of first synthetic thermoplastic fiber-forming polyester containing uniformly dispersed therein from 3 to 40% by weight of electrically conductive carbon black, said electrically non-conductive segments consisting essentially of second synthetic thermoplastic fiber-forming polyester which second polyester is different from said first polyester, said electrically non-conductive segments being continuously bonded and having full adhesion to said electrically conductive segments along the entire length of said filament, the sum of the cross-sectional areas of said electrically conductive segments being less than 50% of the total cross-sectional area of said filament and the sum of the exposed areas of said electrically conductive segments on the surface of said filament being less than 30% of the total surface area of said filament.

3. A unitary, elongated, electrically conductive, composite, melt-spun filament which in transverse cross section consists of from 2 to 8 electrically conductive segments whose inner ends are integral with each other at a common center located in the central interior portion of the filament and which radiate outwardly from said center and extend to the perimeter of the filament with the outer ends of said electrically conductive segments being exposed on the outer surface of said filament, the spaces between said electrically conductive segments outwardly from said center being filled with electrically non-conductive segments whereby said electrically conductive segments are isolated from each other except at said center and only the outer ends of said electrically conductive segments are exposed, said electrically conductive segments having an electrical resistance of less than $1\times10^{13}$ Ω/cm and consisting essentially of first synthetic thermoplastic fiber-forming polyolefin containing uniformly dispersed therein from 3 to 40% by weight of electrically conductive carbon black, said electrically non-conductive segments consisting essentially of second synthetic thermoplastic fiber-forming polyolefin which second polyolefin is different from said first polyolefin, said electrically non-conductive segments being continuously bonded and having full adhesion to said electrically conductive segments along the entire length of said filament, the sum of the cross-sectional areas of said electrically conductive segments being less than 50% of the total cross-sectional area of said filament and the sum of the exposed areas of said electrically conductive segments on the surface of said filament being less than 30% of the total surface area of said filament.

4. The composite filament as claimed in claim 1, claim 2 or claim 3 in which said electrically conductive segments contain from 15 to 30% by weight of electrically conductive carbon black.

5. The composite filament as claimed in claim 1, claim 2 or claim 3, wherein the electrical resistance of said electrically conductive segments is less than $1\times10^{11}$ Ω/cm.

6. The composite filament as claimed in claim 1, claim 2 or claim 3, wherein said electrically conductive segments are of substantially uniform thickness.

7. The composite filament as claimed in claim 1, claim 2 or claim 3, wherein the thicknesses of said electrically conductive segments progressively increase in a direction away from said center.

8. The composite filament as claimed in claim 1, claim 2 or claim 3, wherein the thicknesses of said electrically conductive segments progressively increase in a direction toward said center.

9. The composite filament as claimed in claim 1, claim 2 or claim 3 wherein the sum of the exposed areas of said electrically conductive segments on the surface of the filament is less than 15% of the total surface area of said filament.

10. The composite filament as claimed in claim 9, wherein the sum of the cross-sectional areas of said electrically conductive segments is less than 35% of the total cross-sectional area of said filament.

11. The composite filament as claimed in claim 9, wherein the sum of the cross-sectional areas of said electrically conductive segments is less than 10% of the total cross-sectional area of said filament.

12. The composite filament as claimed in claim 1, claim 2 or claim 3, consisting of two electrically conductive segments and two electrically non-conductive segments, one of said electrically non-conductive segments being made of a homopolymer of a monomer and the other of said electrically non-conductive segments being made of a copolymer containing monomer units of the same monomer as said homopolymer, whereby said filament is self-crimpable.

13. The composite filament as claimed in claim 1, claim 2 or claim 3, containing 2 radially extending electrically conductive segments.

14. The composite filament as claimed in claim 1, claim 2 or claim 3, containing 3 to 6 radially extending electrically conductive segments.

15. The composite filament as claimed in claim 1, claim 2 or claim 3 containing 3 or 4 radially extending electrically conductive segments.

* * * * *

UNITED STATES PATENT AND TRADEMARK OFFICE

CERTIFICATE OF CORRECTION

PATENT NO. : 4 309 479

DATED : January 5, 1982

INVENTOR(S) : Tsutomu Naruse et al

It is certified that error appears in the above—identified patent and that said Letters Patent is hereby corrected as shown below:

Column 13, Line 61; change "sege-" to ---seg- ---.

Column 14, Line 21; change "of" (second occurrence) to ---to---.

Signed and Sealed this

*Sixth* Day of *April 1982*

[SEAL]

*Attest:*

GERALD J. MOSSINGHOFF

*Attesting Officer*

*Commissioner of Patents and Trademarks*